US005968271A

United States Patent [19]

Maxwell et al.

[11] Patent Number: 5,968,271

[45] Date of Patent: Oct. 19, 1999

[54] PAINTING METHOD AND APPARATUS

[75] Inventors: Ian Maxwell; Philip John Insull, both of Oakville; L. Robert Kilburn, Etobicoke; David Robert Jacques, Burlington; Andrew William Lee, Oakville, all of Canada

[73] Assignee: Imax Corporation, Mississauga, Canada

[21] Appl. No.: 08/798,201

[22] Filed: Feb. 10, 1997

[51] Int. Cl.[6] ..... B05C 7/00

[52] U.S. Cl. ..... 118/671; 118/323; 118/712

[58] Field of Search ..... 118/663, 671, 118/300, 323, 305, 712; 239/750, 752, 753, 71; 52/749.1; 134/137, 144; 15/322, 354; 248/918, 75, 77

[56] References Cited

U.S. PATENT DOCUMENTS

| | | | |
|---|---|---|---|
| 2,543,436 | 2/1951 | Chappen | 118/305 |
| 3,581,441 | 6/1971 | Hulbert, Jr. | 302/20 |
| 3,863,393 | 2/1975 | Goff | 118/305 |
| 3,914,077 | 10/1975 | Lodes | 239/177 |
| 4,108,105 | 8/1978 | Wiggins | 118/323 |
| 4,278,046 | 7/1981 | Clarke et al. | 118/323 |
| 4,296,317 | 10/1981 | Kraus | 118/323 |
| 4,501,223 | 2/1985 | Matsuno et al. | 118/305 |
| 5,111,997 | 5/1992 | Ikuta et al. | 239/750 |
| 5,203,923 | 4/1993 | Hartman | 118/669 |
| 5,273,059 | 12/1993 | Gross et al. | 118/315 |
| 5,358,568 | 10/1994 | Okano et al. | 118/327 |

FOREIGN PATENT DOCUMENTS

| | | | |
|---|---|---|---|
| 1 364 107 | 8/1974 | United Kingdom | 118/305 |
| 2167688 | 6/1986 | United Kingdom | 118/305 |
| WO 85 01457 | 4/1985 | WIPO | 118/305 |

*Primary Examiner*—David A. Simmons
*Assistant Examiner*—Calvin Padgett
*Attorney, Agent, or Firm*—Bereskin & Parr

[57] ABSTRACT

A paint spray rig is disclosed for applying "high gain" reflective paints to a motion picture projection screen. The rig includes a tower which extends vertically of the screen and which can be indexed laterally across the screen. A paint spray head is carried by a carriage assembly that is vertically movable on a tower. The spray head can be moved towards and away from the screen under the control of ultrasonic sensors that measure the distance between the spray head and the screen, for maintaining the distance substantially constant. The spray head can also be moved progressively in the vertical direction with respect to the carriage so that it is at the bottom of the carriage for painting the bottom edge of the screen and at the top of the carriage for painting the top edge of the screen. The spray head can also be swapped from one side of the carriage to the other for painting opposite side edge portions of the screen.

11 Claims, 3 Drawing Sheets

FIG.4.
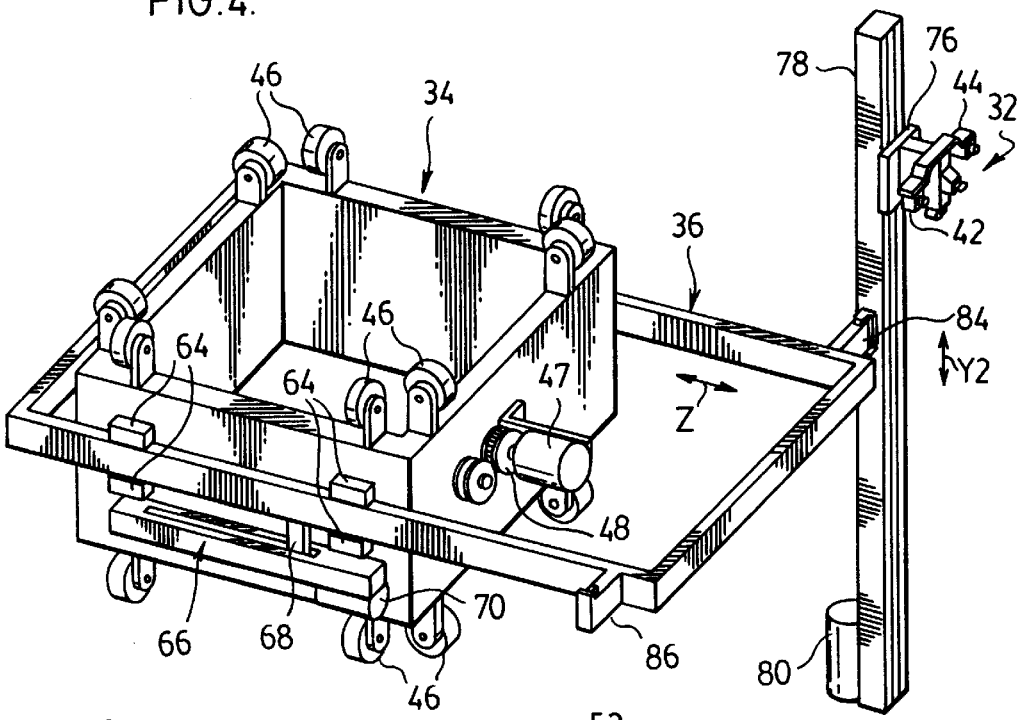
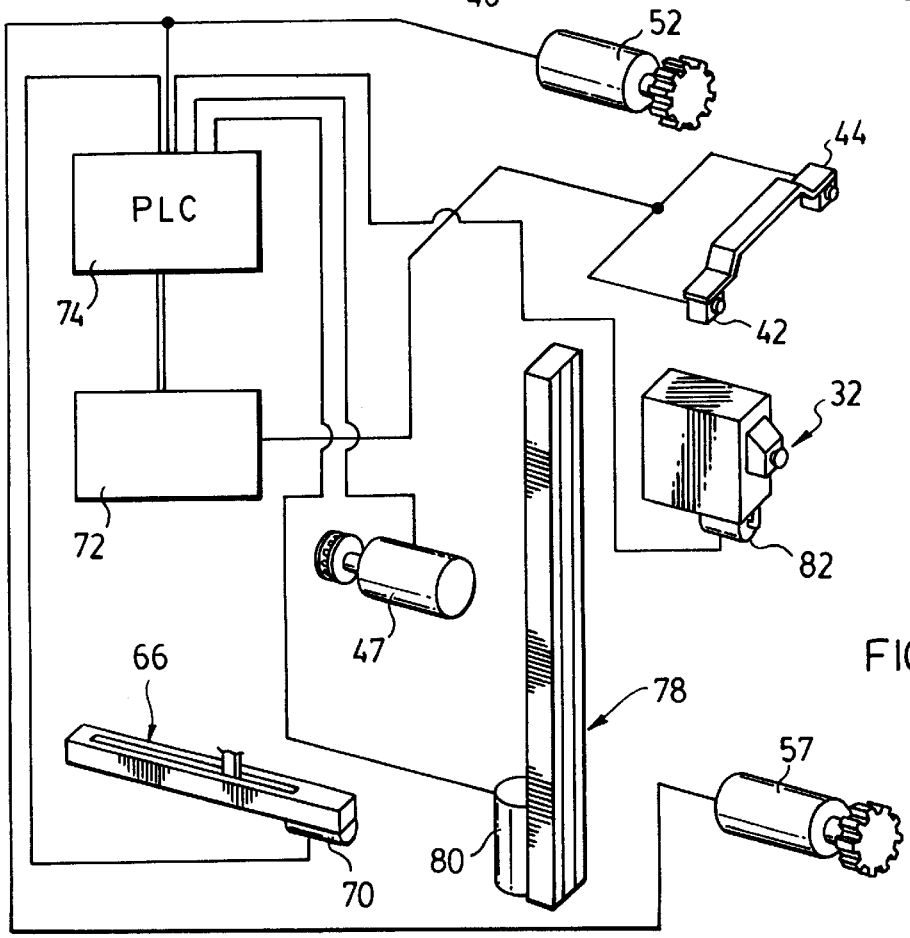
FIG.5.

PAINTING METHOD AND APPARATUS

FIELD OF THE INVENTION

This invention relates to a method and apparatus for spray painting generally vertical surfaces such as the surface of a screen on which a motion picture is to be projected.

BACKGROUND OF THE INVENTION

In the field of high-quality motion picture projection systems such as those available from Imax Corporation, great emphasis is placed on image brightness. One factor in achieving high levels of image brightness is the reflective characteristics of the screen on which images are projected. Special so-called "high gain" reflective paints have been developed that are applied to the image receiving surface of the screen. In the case of 3-D projection systems in which the projected light is polarized, the paint also has the effect of preserving linear polarization of the light.

At least in the case of screens other than domed screens, the paint typically is applied to the screen using a spray gun as the screen is erected in a theatre. A single coat of paint is applied to the front surface of the screen by moving the gun across the screen as it is withdrawn upwardly from a housing on the floor of the theatre.

The present inventors have recognized that it is important to maintain a constant paint spray fan width as the paint contacts the screen, over the entire screen surface. If the width of the spray changes due to bulges in the screen (in or out), the same thickness of paint may not be applied to all areas of the screen. This affects the appearance of the screen and can lead to visible vertical stripes. In addition, a narrower paint spray would have a greater concentration of paint than a wider area, and vice versa; this will affect the drying time of the paint which can exacerbate the appearance of stripes.

So far as is known, the prior art fails to provide a solution to this problem. It has been proposed to use mechanical sensors to space a spray gun from a surface to receive paint. For example, U.S. Pat. No. 4,296,317 (Kraus) shows a spray gun which is fitted with a wheel adjacent the gun nozzle for maintaining a constant distance between the paint gun nozzle and the surface of a work piece to be painted. U.S. Pat. No. 4,108,105 (Wiggins) discloses a paint spray system in which a mechanical sensor is used to determine the width of a workpiece and then control the distance of the paint nozzles from the workpiece. However, mechanical sensors that contact the surface to be painted are not acceptable in the case of motion picture screens because of the risk of marking or otherwise damaging the screen.

Examples of other prior art patents of which applicant is aware are U.S. Pat. Nos. 4,278,046 (Clarke et al.) and 5,203,923 (Hartman).

An object of the present invention is to provide a painting method and apparatus which is designed to permit the application of substantially uniform paint coatings to motion picture projection screens and other vertical surfaces.

SUMMARY OF THE INVENTION

In a method aspect, the invention comprises the steps of spraying paint onto the surface from a spray head while moving the spray head with respect to the surface in a predetermined pattern; continuously sensing the distance between the spray head and the surface in the area in which paint is being applied to the surface using at least one non-contact sensor that directs a sensing beam onto the surface; generating from said sensor, data representative of said distance; and continuously adjusting the position of the spray head with respect to the surface in response to said data to maintain said distance substantially constant. Preferably, the sensor is an ultrasonic sensor.

A corresponding apparatus comprises a paint spray head and means supporting a head for movement in a predetermined pattern over said surface. Non-contact sensor means is provided in association with the spray head and is adapted to direct a sensing beam onto the surface for continuously sensing the distance between the spray head and the surface in the area in which paint is being applied to the surface, and generating data representing said distance. Means is also provided for continuously adjusting the position of the spray head with respect to the surface in response to said data to maintain said distance substantially constant.

The invention permits maintenance of a constant paint spray fan width as the paint contacts the surface (e.g. a movie screen) over the entire surface of the screen even where bulges or other imperfections in the screen are encountered. The spray head moves in or out automatically in response to in or out bulges in the screen, maintaining a constant spray fan width, and assuring uniform painting of the entire screen area. At the same time, there is no physical contact with the screen surface which could result in marks or other damage that might be visible when the screen is in use. Multiple coats of paint may be applied in accordance with the method of the invention.

A generally upright surface to be painted can be considered as having an X dimension and a Y dimension in directions which are mutually perpendicular (horizontal and vertical respectively). Preferably, the means supporting the spray head of the apparatus of the invention includes an elongate support member which extends in either the X direction or the Y direction (e.g. vertical—the Y direction) and generally parallel to and spaced from the surface to be painted. Means is provided for progressively moving the support member in the other direction (e.g. the X direction—horizontally) through a plurality of mutually parallel positions. A carriage is coupled to the support member for movement along the member and means is provided for moving the carriage progressively along the member. The paint spray head is supported on the carriage for movement towards and away from the screen (in the Z direction) and an actuator is provided for controlling movement in said direction. The sensor means is carried by the spray head and senses the distance between the spray head and the surface. The resulting data is used for controlling the actuator in accordance with the data to maintain the distance of the paint head from the surface in the Z direction at least substantially constant.

Preferably, the provision is made to also move the spray head with respect to the carriage in the direction in which the elongate support member extends (e.g. the Y direction). In other words, there is differential movement between the spray head and the carriage as the carriage moves along the support member. For example, if the support member extends vertically (as will usually be the case) the carriage will move vertically along the support member. The spray head will also move vertically with respect to the carriage. This allows the spray head to be positioned as low as possible with respect to the support member when the support member is in its bottom position, for painting the bottom edge of the screen, and for the spray head to be positioned as high as possible when the carriage reaches the top of the support member, for painting the top edge of the screen.

Space limitations often are of major concern in a motion picture theatre, particularly where the screen is to be used for projecting large format images such as those that are produced using IMAX™ projection systems. Typically, the screen will fill substantially the entire available space in the theatre. As such, it is important that the screen painting apparatus (paint rig) be as compact as possible. The described feature of differential movement between the spray head and the carriage allows that objective to be accomplished at least in the vertical direction. Also for reasons of compactness, the support member preferably extends in the vertical direction. While it would be possible to have the support member extend horizontally, this would require tracks or other support structure at the sides of the screen, where space generally is not available. However, this may not be a concern in other applications or where small screens are being painted.

In order to take account of space limitations laterally of the screen when the support member extends vertically, provision preferably is made for the paint gun to be positioned in either of two alternative locations on opposite sides of the support member (or "tower") and to be interchangeable between those two positions, i.e. to the left side of the tower for painting the left-hand edge of the screen and to the right side of the tower for painting the right edge.

BRIEF DESCRIPTION OF THE DRAWINGS

In order that the invention may be more clearly understood, reference will now be made to the accompanying drawings which illustrate a particular preferred embodiment of the invention by way of example, and in which:

FIG. 4 is a perspective view of the carriage and an associated secondary carriage (which carries the paint spray head); and, FIG. 5 is a schematic illustration of the overall control system for the paint spray head.

DESCRIPTION OF PREFERRED EMBODIMENTS

Figure 1:
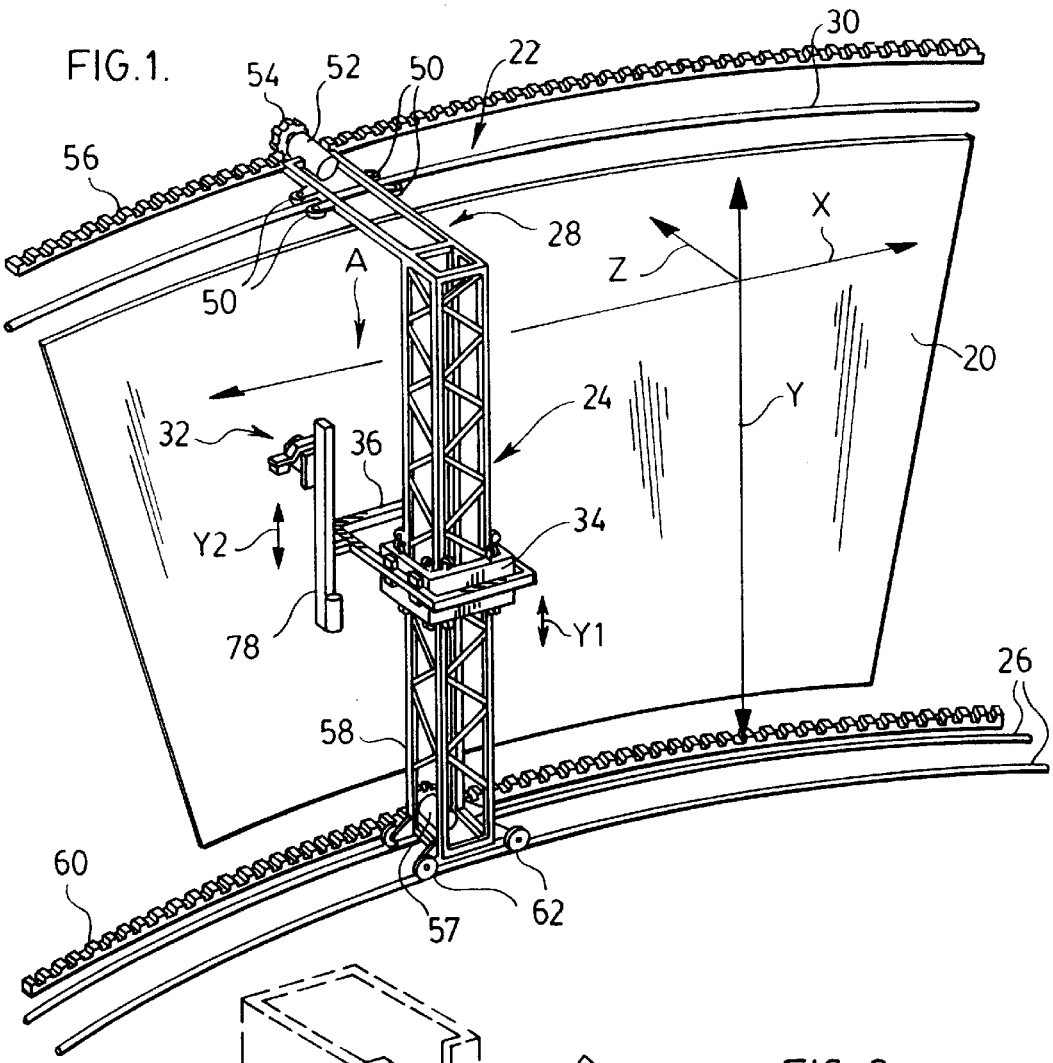
FIG. 1 is an overall perspective view of a paint rig in accordance with the invention shown in association with a motion picture projection screen to be painted.

Referring first to FIG. 1, a projection screen for a motion picture theatre is generally indicated by reference numeral 20. In this embodiment, the screen is made of a vinyl material and is tensioned between upper and lower supports, which have not been shown since the screen structure itself is known. The screen has horizontal and vertical dimensions which are generally indicated at X and Y. Typically, the screen will not in fact be truly rectangular and is not shown as such. This is necessary in order to accommodate image configuration as determined by the theatre design and projector characteristics. The screen may also be slightly convexly curved as seen in plan.

A rig for applying paint to the front surface of the screen is generally denoted by reference numeral 22 and includes an upright support member or tower 24 that extends in the vertical (Y) direction of the screen over slightly more than the total screen height. Tower 24 extends parallel to and is spaced outwardly from the front surface of the screen. The tower is supported at its lower end on a removable track 26 having a general configuration that follows the curvature of the screen. At its upper end, the tower is carried by a frame or bracket 28 from a further track 30 that is permanently installed in the theatre above the screen, again generally in a configuration that follows the screen curvature.

A paint spray head generally indicated at 32 is carried from tower 24 by carriages 34 and 36 (shown only schematically in FIG. 1) so that the head 32 can be moved up and down the tower for applying "bands" of paint to the screen in the vertical direction. The tower can also be indexed to successive laterally spaced positions on the two tracks 26 and 30 so that the vertical bands of paint can be applied over the lateral extent of the screen.

Figure 2:
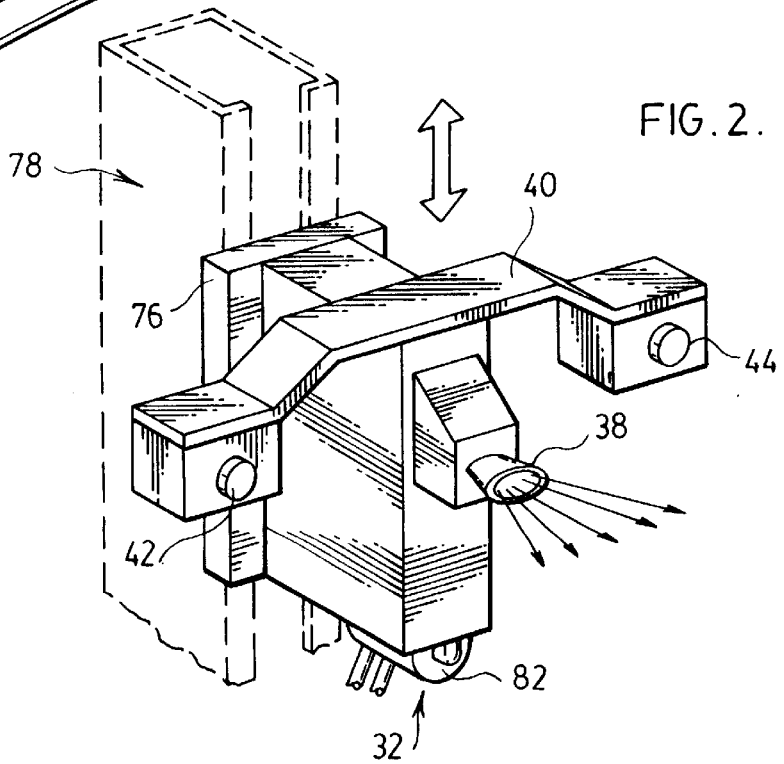
FIG. 2 is a diagrammatic plan view of the paint spray head of the rig.

The paint spray head is shown somewhat diagrammatically in FIG. 2 and, in essence, comprises a paint spray gun having a nozzle 38, and a support 40 that also carries two ultrasonic sensors 42 and 44 on respectively opposite sides of the spray gun.

The two carriages that support the spray head 32 on the tower 24 may be regarded as a primary carriage 34 and a secondary carriage 36. The two carriages are shown in detail in FIG. 4. The primary carriage is movable vertically up and down tower 24 in a direction which is indicated by the arrow Y1 in FIG. 1. The secondary carriage 36 is coupled to carriage 34 so that it can move towards and away from the screen in a direction denoted 2 to vary the distance between the spray head 32 and the screen surface. In addition, the spray head 32 can move up and down on the secondary carriage 36 in a direction which is denoted Y2 in FIG. 1. As will be described in more detail later, the paint rig is operated so that the spray head is initially disposed towards the lower end of carriage 36 for painting the bottom edge of the screen. As the primary carriage 34 moves up tower 24, spray head 32 is progressively moved up on carriage 36 (in the Y2 direction) so that by the time the primary carriage reaches the top of the tower, the spray head 32 is at the top of the secondary carriage, for painting the top edge of the screen. This allows the overall height of the paint rig to be kept to a minimum due to space constraints within a typical theatre, as discussed previously.

It will be seen that the paint spray head 32 is shown at the left-hand side of the primary carriage 34 as drawn in FIG. 1. This is the position of the spray head for painting the left-hand edge of the screen. The rig is designed so that, when tower 24 is traversed to the right, the spray head 32 can be moved to the right hand side of the primary carriage 34 ("gun swap") for painting the right hand side of the screen. Again, this feature is provided in order to take account of space limitations at opposite sides of the screen.

Figure 3:
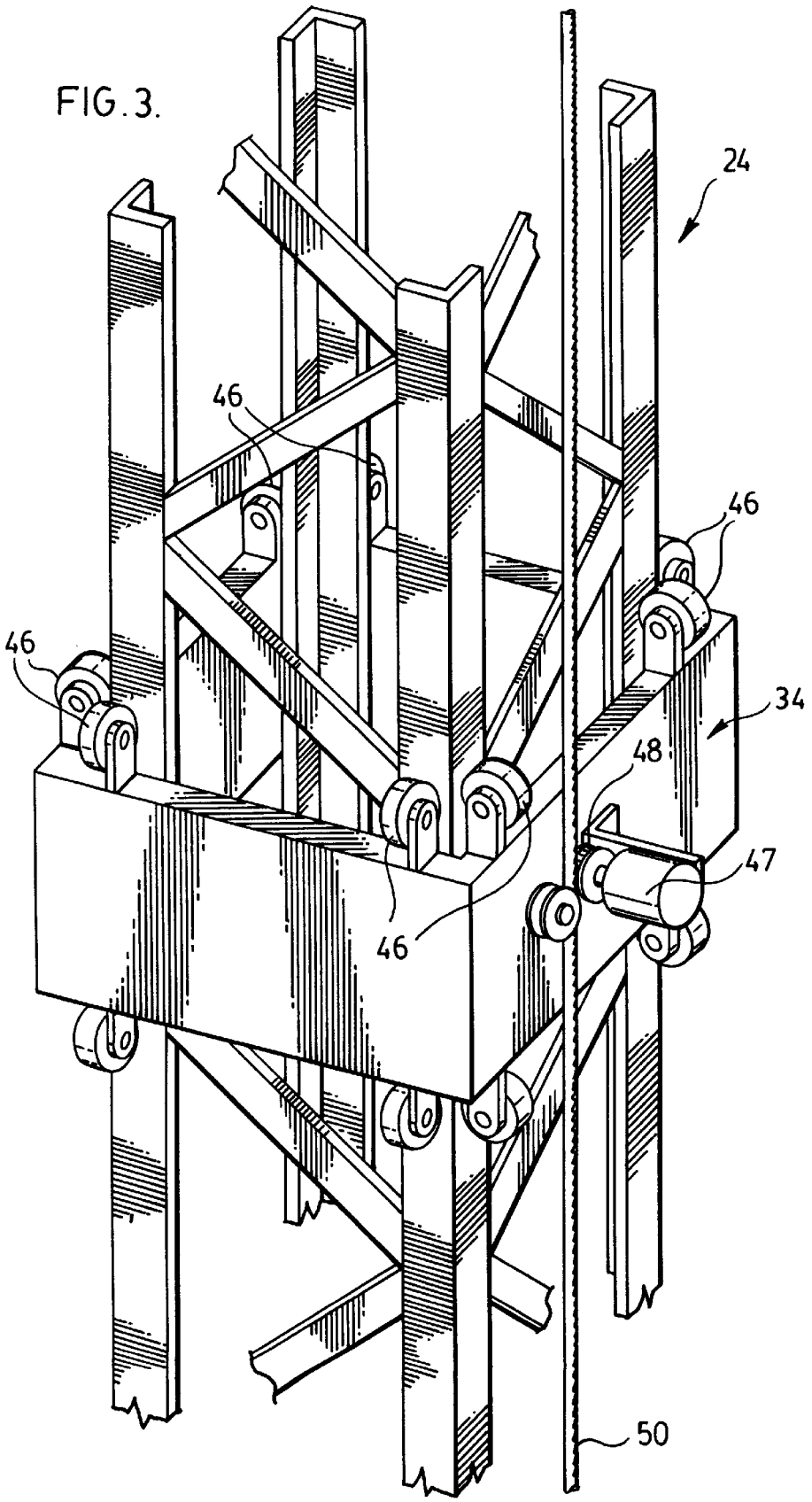
FIG. 3 is a perspective view of part of the tower of the rig showing a primary carriage that is movable vertically on the tower.

Reference will now be made to FIGS. 3 and 4 in describing the structure of the paint rig in more detail. FIG. 3 shows a section of the vertical tower 24 with the primary carriage 34 mounted on the tower. It will be seen that the tower is essentially an elongate rectangular box of "open" space frame construction. The primary carriage is a rectangular frame that is designed to surround the tower. A series of wheels 46 on carriage 34 run on the corners of the tower. An electric motor 47 on carriage 34 drives a toothed wheel 48 that engages a toothed belt 50 extending from top to bottom of the tower, for driving the carriage vertically along the tower. Belt 50 is not shown in FIG. 1. FIG. 1 does, however, show that a similar belt drive arrangement is provided for traversing the tower in the horizontal (X) direction. Frame 28 at the top of the tower carries a motor 52 which drives a toothed wheel 54 in engagement with a belt 56 that is installed parallel to the upper track 30. Wheels on bracket 28 that run on track 30 are shown diagrammatically at 56. Similarly, a motor 57 at the lower end of the tower drives a toothed wheel 58 in engagement with a toothed belt 60 that extends parallel to track 26. Wheels supporting the bottom of the tower are indicated at 62.

In FIG. 4, the primary carriage 34 is shown generally as seen in the direction of arrow A in FIG. 1 (looking outwardly from the screen to the right of the tower). It will be seen that the secondary carriage 36 is essentially a rectangular frame that extends around the primary carriage 34 and is elongated somewhat in the Z direction so as to permit adjustability of the secondary carriage 36 with respect to the primary carriage 34 in that direction. Pairs of linear bearings (two of which are visible) are provided on respectively opposite sides of the primary carriage 34 for supporting the secondary carriage. The visible pairs of bearings are indicated at 64 in FIG. 4.

Mounted on one side of the primary carriage 34 below the secondary carriage 36 is a horizontal linear actuator 66 that is coupled to the secondary carriage 36 at 68, for effecting movement of the secondary carriage with respect to the primary carriage in the Z direction. Actuator 66 includes a motor 70 which is controlled in accordance with data generated by the two ultrasonic sensors 42 and 44 (FIG. 2) to position the secondary carriage 36 in the Z direction so as to maintain constant the distance between the paint spray gun 38 and the screen 20.

The two sensors 42 and 44 and the spray head 32 are shown in FIG. 5. The sensors provide signals to a signal evaluator 72 which averages the two signals and provides an analog signal to a programmable logic controller (PLC) 74, which in turn controls motor 70. It has been found in practice that better results are obtained when an average of signals from two sensors is used to control the position of the gun. Also, with two sensors, there will always be one sensor in front of the screen near the edges.

PLC 74 is programmed to position the paint gun 38 within in a "window" that is within plus or minus one half inch from an optimum distance (say about 12 inches) from the surface of the screen. When the sensor output indicates that the paint gun is no longer within the "window" a signal is sent to the actuator motor 70 which causes the paint gun to travel in the direction required to return the gun to the "window". Typically, the gun may move up to 18 inches away from the screen in the course of one vertical painting pass when painting near the middle of the screen (the worst location for bulging). Obviously, the rectangular frame comprising carriage 36 must be sized to allow the maximum required travel of the paint gun.

In a practical embodiment, the two sensors 42 and 44 are Siemens Ultra Sonic Sensors P/N 3RG6 143-3MMOO and the evaluator 72 is a Sonar Signal Evaluator P/N 3RX21100. The motor 70 is an IDC B8961-NP Single Axis Brushless Servo Smart Drive, and the linear actuator is a Brushless Servo Rodless Actuator P/N R3B23-155B-48-P-B-SM.

With continued reference to FIG. 4, it will be seen that the paint spray head 32 is mounted on a support 76 carried by a further linear actuator 78 mounted on the secondary carriage 36. In this case, actuator 78 is vertically mounted so that the spray gun support 76 can be moved vertically with respect to carriage 36 (in the Y2 direction—FIG. 1). A motor for driving the actuator 78 is shown at 80. Also shown at 82 in FIG. 5 is a solenoid for pulling the trigger of the spray gun of spray head 32.

Carriage 36 includes left-hand and right-hand brackets 84 and 86 respectively, on either of which the vertical linear actuator 78 can be removably mounted. This allows the feature of "gun swap" discussed previously. In other words, actuator 78 is mounted on the left-hand bracket 84 for painting the left-hand edge of the screen but can be detached and fitted to the right-hand bracket 86 when the right-hand edge of the screen is to be painted. Suitable clamps (not shown) are provided for securing actuator 78 to the relevant bracket.

In a practical embodiment, like actuator 66, actuator 78 may be a Brushless Servo Rodless Actuator P/N R3B23-155B-48-P-B-SM. Motor 80 may be an IDC B8961-NP Double Axis Brushless Servo Smart Drive. A similar drive motor is used to drive the toothed wheel 48 (FIG. 3) for vertically moving the primary carriage 34. PLC 74 controls all of the drives for the rig (see FIG. 5); it is programmed to synchronize the Y1 drive for vertical movement of the primary carriage 34 and the Y2 drive (80) for vertical movement of the paint spray head 32. The desired gun velocity is entered into PLC 74, which determines the correct velocities for the respective motors, i.e. so that the paint spray head is at the bottom of the screen when the primary carriage 34 is at the bottom of the tower, and is at the top of the screen when the primary carriage is at the top of the tower.

Preferably, the painting motion is in one stroke with no stops. In a practical embodiment, the primary carriage 34 is 24 inches in height and the paint gun is required to travel to within six inches of the floor and ceiling.

As shown in FIG. 5, PLC 74 also controls the drive motors 52 and 57 for the top and bottom ends of tower 24 (FIG. 1). Where the screen is not rectangular, the two motors are driven at respective speeds that are calculated to ensure that the tower stays vertical.

Precise details of the software that is used to run PLC 74 does not form part of the present invention and, it is believed, can readily be accomplished by a person skilled in the art. Accordingly, details of the software control have not been given. Briefly, the dimensional parameters of the screen 20 will be entered into the control system. To set the X dimension movement of tower 24 (horizontal) the tower is manually traversed over the width of the screen and the travel distance entered into the control system. The difference in the travel of the top and bottom tower motors is calculated and a ratio is created to ensure that the tower stays vertical.

The two carriages 34 and 36 are moved to their desired starting positions and the limits are set. The paint gun is manually moved to the desired distance from the screen and the distance is set. Gun speed, horizontal step size and gun delays are entered into the system. The rig can then operate automatically under control of PLC 74.

Starting from the left-hand side of the screen in FIG. 1, the spray head 32 will be positioned to the left-hand side of tower 24 as discussed previously (actuator 78 on the left-hand bracket 84 in FIG. 4). When the tower approaches the right-hand edge of the screen, the painting head 32 and actuator 78 must be moved from the left-hand bracket 84 (FIG. 4) to the right-hand bracket 96. This operation must happen within 60 seconds so that the wet edge of the paint is not compromised. At this point in the painting process, the paint program being run by PLC 74 is paused and the tower is indexed back so that the paint head 32 is in exactly the same position as it was before the program was paused. The paint program is then resumed.

It will of course be appreciated that the preceding description relates to a particular preferred embodiment and that modifications are possible within the broad scope of the invention. Some of those modifications have been indicated previously and others will be apparent to a person skilled in the art.

Notably, it has previously been pointed out that a horizontal support could be used for the paint head instead of the vertical tower 24 shown in FIG. 1. The support would be indexed in the vertical direction. The primary carriage 34 would then move horizontally along the support and the secondary carriage 36 would also move horizontally with respect to the primary carriage. In the case of motion picture projection screens for large format images, a vertical tower is preferred because of the weight of the tower; if a horizontal support member were used, sagging due to the weight of the member could be a problem. Space limitations at the sides of the screen may also preclude this option. However, a horizontal support may be possible for smaller screens or other applications.

In the described embodiment, the sensors used to control the position of the paint head in the Z direction are ultrasonic sensors. However, other non-contact beam-type sensors such as infrared sensors or lasers may be used. At the present state of technology, it has been found that ultrasonic sensors represent the best option in terms of cost and response time. By way of example, it has been found possible to obtain about 100 data updates per second using an ultrasonic sensing system and that this provides satisfactory response in terms of paint head movement at the typical gun speeds required in practise (e.g. 18 millimeters per second vertical movement). It is believed that the minimum acceptable response time probably is about 50 data updates per second.

Finally, it should be noted that the apparatus provided by the invention may be used to paint structures other than motion picture projection screens. Also, in some situations, e.g. painting a rigid wall, movement of the paint spray head in the "Z" direction may be unnecessary, in which case the features of the apparatus that relate to adjustment of the spray head in that direction may be omitted.

We claim:

1. An apparatus for painting a generally upright surface having an X dimension and a Y dimension which are mutually perpendicular, the apparatus comprising:

an elongate support member which extends across said surface in a first direction corresponding to one of said X dimension and said Y dimension, generally parallel to and spaced from said surface;

means carried by the support member for indexing the support member across said surface in a second direction corresponding to the other said dimension through a plurality of mutually parallel positions;

a carriage coupled to said support member for movement along said member and across said surface in said first direction;

means acting between the carriage and the support member for moving the carriage progressively along said member;

a paint spray head for delivering paint to said generally upright surface;

means supporting the paint spray head on said carriage for movement (1) towards and away from said surface and (2) in said first direction with respect to the carriage between respective end positions for painting respectively opposite marginal portions of said surface;

a first actuator coupled between said carriage and said spray head supporting means for controlling said movement (1) of the spray head towards and away from said surface;

non-contact sensor means carried by the spray head for sensing the distance between the spray head and the surface by directing a sensing beam onto said surface and producing data representing said distance;

means for controlling the actuator in accordance with said data to maintain said distance at least substantially constant;

a second actuator coupled between said spray head supporting means and said spray head for controlling said movement (2) of the spray head in said first direction with respect to the carriage; and, means coupled to said second actuator for controlling said second actuator so that the spray head moves between its respective end positions as the carriage moves across the surface in said first direction.

2. An apparatus as claimed in claim 1, wherein said elongate support member comprises a tower which extends in a generally vertical direction corresponding to said first direction (Y), said indexing means moving the tower in a horizontal direction corresponding to said second direction (X).

3. An apparatus as claimed in claim 2, wherein said carriage is a primary carriage, and said means supporting the paint spray head on said carriage comprises a secondary carriage carried by said primary carriage and moveable towards and away from the surface under the control of said first actuator, and means on said secondary carriage supporting said paint spray head for movement in said vertical direction with respect to the primary carriage.

4. An apparatus as claimed in claim 3, wherein said second actuator is a linear actuator having a driven element to which said spray head is coupled, and wherein said means on said secondary carriage supporting said paint spray head comprises bracket means supporting said second linear actuator in a generally vertical orientation for movement of said spray head in said vertical direction with respect to said primary carriage.

5. An apparatus as claimed in claim 4, wherein said bracket means comprises first and second brackets extending laterally to opposite sides of said secondary carriage outwardly of said primary carriage, and wherein said second linear actuator is adapted to be removably coupled to either of said first and second brackets so that said paint spray head can selectively be positioned at either side of said primary carriage.

6. An apparatus as claimed in claim 2, wherein said tower comprises an elongate box section structure, and wherein said primary carriage comprises a rectangular frame surrounding said tower and coupled thereto for movement along the tower.

7. An apparatus as claimed in claim 6, wherein said secondary carriage comprises a rectangular frame which extends around said primary carriage and wherein the apparatus further comprises means supporting said frame on said primary carriage for generally horizontal movement towards and away from said surface.

8. An apparatus as claimed in claim 2, wherein said indexing means comprises respective upper and lower tracks disposed above and below said surface and disposed generally parallel to respective top and bottom edges of the surface; means coupling respective upper and lower ends of said tower to the respective tracks for movement of the tower along said tracks; and drive means at the respective upper and lower ends of said tower for indexing the tower along said tracks in synchronism and moving the tower through a plurality of mutually parallel vertical positions.

9. An apparatus as claimed in claim 1, wherein said non-contact sensor means comprises at least one ultra-sonic sensor.

10. An apparatus as claimed in claim 9, wherein said spray head comprises a spray gun and first and second ultrasonic sensors disposed on respectively opposite sides of said spray gun, said sensor means further comprising evaluator means coupled to said first and second sensors for averaging signals provided by said sensors and producing said data as representing the average distance sensed by each sensor.

11. An apparatus for painting a generally upright surface having an X dimension and a Y dimension which are mutually perpendicular, the apparatus comprising:

an elongate support member which extends across said surface in a first direction corresponding to one of said X dimension and said Y dimension, generally parallel to and spaced from said surface;

means carried by the support member for indexing the support member across said surface in a second direction corresponding to the other said dimension through a plurality of mutually parallel positions;

a carriage coupled to said support member for movement along said member and across said surface in said first direction;

means acting between the carriage and the support member for moving the carriage progressively along said member;

a paint spray head for delivering paint to said generally upright surface;

means supporting the paint spray head on said carriage for movement (1) towards and away from said surface and (2) in said first direction with respect to the carriage between respective end positions for painting respectively opposite marginal portions of said surface;

a first actuator coupled between said carriage and said spray head supporting means for controlling said movement (1) of the spray head towards and away from said surface;

non-contact sensor means carried by the spray head for sensing the distance between the spray head and the surface by directing a sensing beam onto said surface and producing data representing said distance;

means for controlling the actuator in accordance with said data to maintain said distance at least substantially constant;

a second actuator coupled between said spray head supporting means and said spray head for controlling said movement (2) of the spray head in said first direction with respect to the carriage; and, means coupled to said second actuator for controlling said second actuator so that the spray head moves between its respective end positions as the carriage moves across the surface in said first direction;

wherein said spray head comprises a spray gun and first and second ultrasonic sensors disposed on respectively opposite sides of said spray gun, said sensor means further comprising evaluator means coupled to said first and second sensors for averaging signals provided by said sensors and producing said data as representing the average distance sensed by each sensor.

* * * * *